United States Patent [19]

Glatter

[11] Patent Number: 4,459,645

[45] Date of Patent: Jul. 10, 1984

[54] ILLUMINATING EARRING WITH COAXIAL CONDUCTOR ARRANGEMENT

[76] Inventor: Howard Glatter, 257 West 38th St., New York, N.Y. 10018

[21] Appl. No.: 325,657

[22] Filed: Nov. 30, 1981

[51] Int. Cl.[3] ..... F21L 15/08

[52] U.S. Cl. ..... 362/104; 362/205; 362/276; 362/295; 362/191; 362/800; 362/806; 362/386; 174/50.55

[58] Field of Search ..... 362/104, 800, 806, 203, 362/276, 205, 295, 191, 386; 174/50.55, 152 GM GM

[56] References Cited

U.S. PATENT DOCUMENTS

| | | | |
|---|---|---|---|
| 2,173,473 | 9/1939 | Edwards | 174/50.55 X |
| 3,384,740 | 5/1968 | Wood | 362/802 X |
| 3,866,035 | 2/1975 | Richey, Jr. | 362/104 |
| 3,916,264 | 10/1975 | Berg | 338/22 R |
| 4,076,976 | 2/1978 | Fenton | 362/104 |
| 4,309,743 | 1/1982 | Martin | 362/104 |
| 4,337,504 | 6/1982 | Simpson | 362/800 X |

FOREIGN PATENT DOCUMENTS

| | | | |
|---|---|---|---|
| 2720925 | 11/1978 | Fed. Rep. of Germany | 362/800 |

*Primary Examiner*—Donald G. Kelly
*Assistant Examiner*—John S. Maples
*Attorney, Agent, or Firm*—Lilling & Greenspan

[57] ABSTRACT

An illuminating earring includes a light-emitting diode (LED) mounted on a base. A battery-containing case is electrically and mechanically connected to the base through a hollow shaft and conductor coaxial arrangement dimensioned to pass through a hole in a pierced ear so that current flow between the LED and the batteries takes place only through the hole in the ear when the earring is worn and operational.

18 Claims, 5 Drawing Figures

ILLUMINATING EARRING WITH COAXIAL CONDUCTOR ARRANGEMENT

BACKGROUND OF THE INVENTION

The present invention relates to an earring for a pierced ear; more particularly, the invention relates to an earring having built-in means for illumination.

The jewelry art is as old as the recorded history of man. Even the earliest human cultures seemed to have a well-developed desire to adorn the human body. Countless types of jewelry have been developed throughout the ages, but certain particular types appear to be most prevelant. These are: rings, bracelets, necklaces and earrings. Considering the art of earrings alone, it is safe to say that literally millions of styles have been developed.

One of the earring styles that has gained wide acceptance in the jewelry art is the simple stone which is mounted at the end of a shaft designed to pass through the hole in a pierced ear. This stone is thus worn as an adornment on the earlobe at the place where the lobe is pierced.

It is known to provide jewelry of various types with a battery and means for illumination. The most common example of such jewelry is a digital wristwatch, for example with an LED display. It is also known to provide a digital watch pendant as well as a pendant containing batteries and an LED display which is for decorative purposes only.

SUMMARY OF THE INVENTION

It is an object of the present invention to provide an earring, particularly an earring for a pierced ear, with a means for illumination.

This object, as well as other objects, which will become apparent from the discussion that follows, are achieved, according to the present invention, by (1) arranging a miniature electric lamp, such as an LED, on a base much in the same way that a stone is mounted on a base in a conventional earring; (2) providing a power source which includes a case containing a battery and a small electronic circuit connected to receive current from the battery and (3) providing a stem which is adapted to be passed through the hole in the pierced ear and which both mechanically and electrically interconnects the light source with the power source.

For a full understanding of the present invention, reference should now be made to the following detailed description of the preferred embodiment of the invention and to the accompanying drawings.

DESCRIPTION OF THE PREFERRED EMBODIMENT

Figure 1:
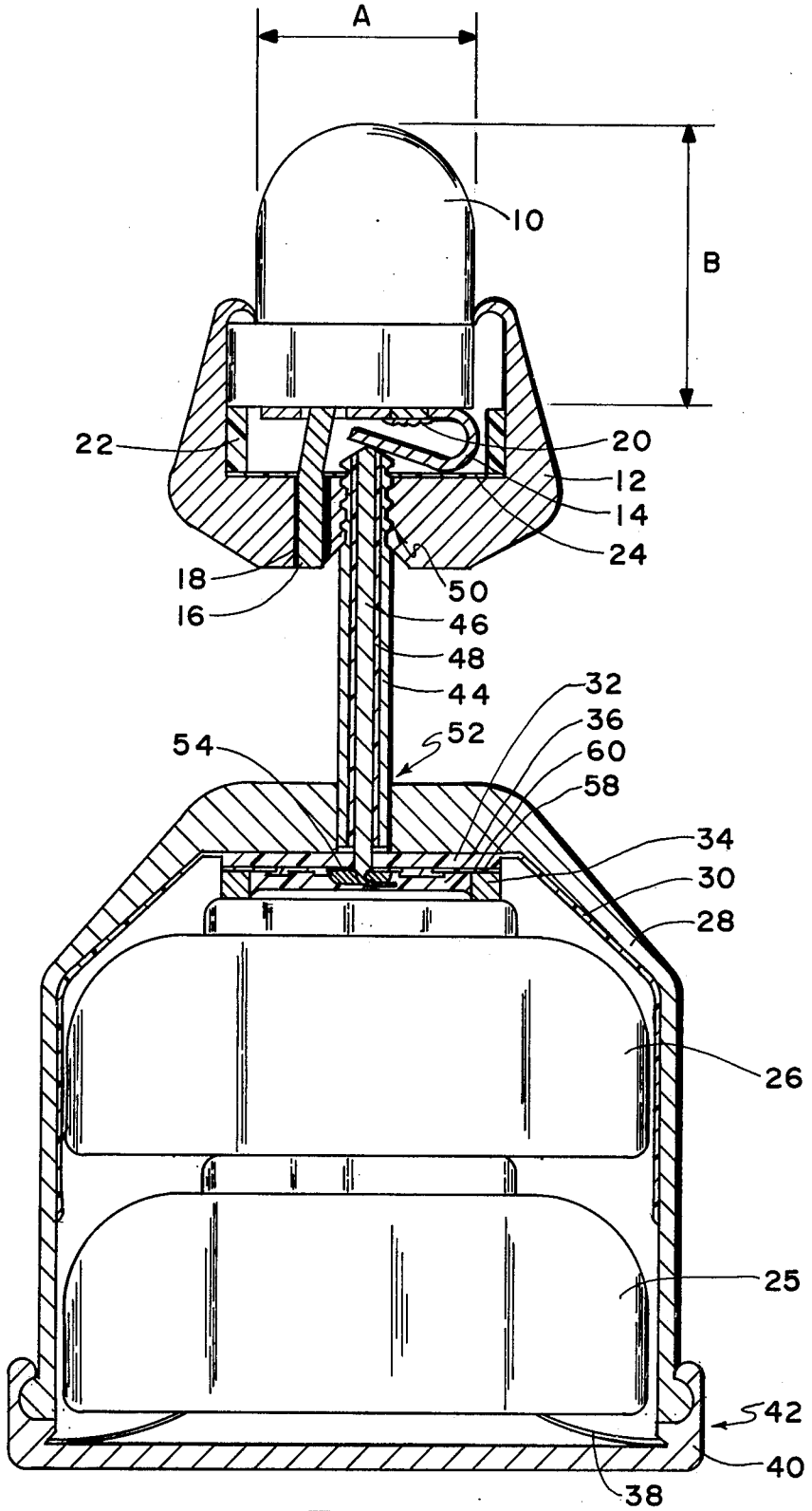
FIG. 1 is a cross-sectional view of an illuminating earring according to the preferred embodiment of the present invention.
Figure 2:
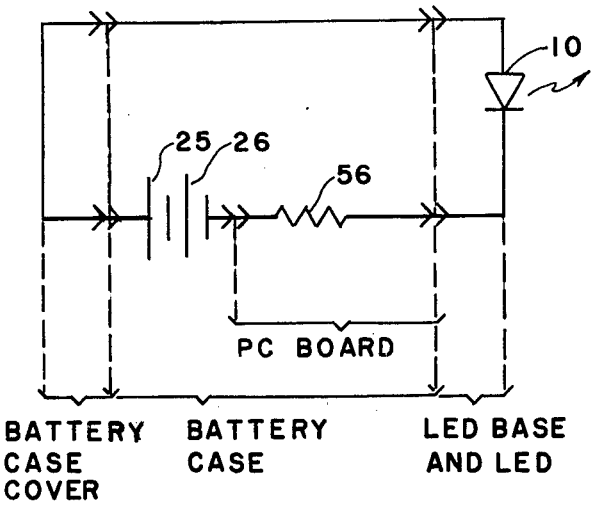
FIG. 2 is a schematic diagram of a first electric circuit for the earring of FIG. 1.
Figure 3:
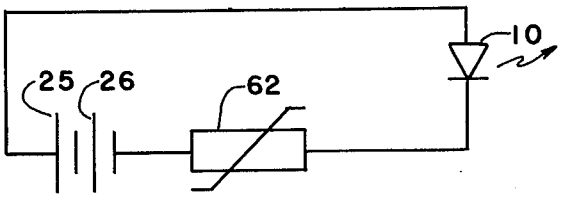
FIG. 3 is a schematic diagram of a second electric circuit for the earring of FIG. 1.
Figure 4:
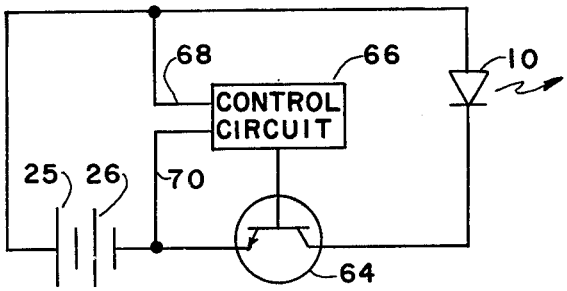
FIG. 4 is a schematic diagram of a third electric circuit for the earring of FIG. 1.
Figure 5:
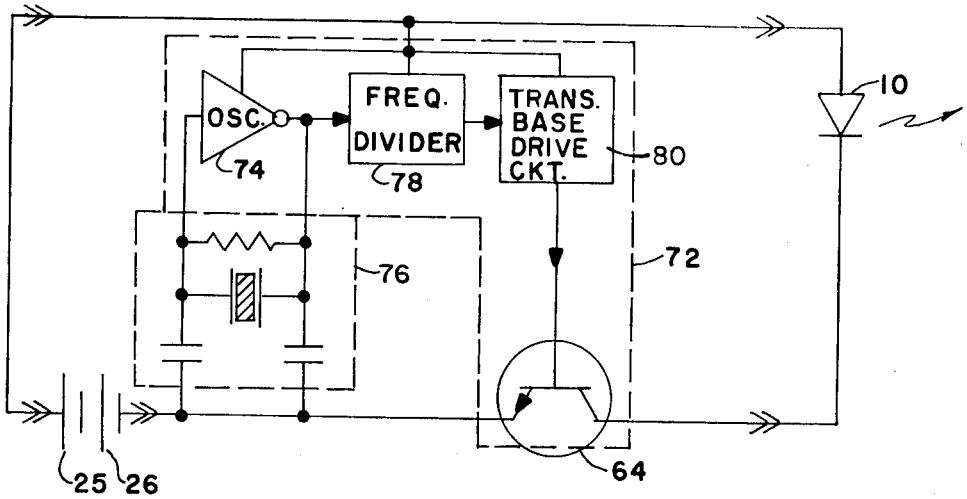
FIG. 5 is a schematic diagram of a fourth electric circuit for the earring of FIG. 1.

The preferred embodiment of the present invention will now be described with reference to FIGS. 1–5. FIGS. 1 and 2 show that a preferred embodiment of the LED earring according to the present invention and FIGS. 3–5 show various alternative circuits which may be used in an LED earring.

As may be seen in FIG. 1, the earring comprises a light source to be worn and displayed on the ear including an LED 10, a metal LED base 12 and an electrical contact spring 14. As is well known, LEDs are available in various colors. Any one of the following LEDs, available from Monsanto Corp., would serve in this application:

TABLE 1

| Color | LED Type |
|---|---|
| Orange | MV5177 |
| Green | MV5277 |
| Yellow | MV5377 |
| Red | MV5777 |

The LEDs listed in Table 1 are approximately 0.130 inches in diameter (distance A) and 0.150 inches high (distance B). In the earring the LED is secured in place on the base 12 by rolling over the upper lip of the base to form a bezel.

Electrical contact is made to the LED by a first lead 16 which is electrically connected to the metal case 12 by solder 18 and by the contact spring 14 which is electrically connected with a second lead of the LED by solder 20. The contact spring is insulated from the metal LED base 12 by a circumferential glass-epoxy spacer (tubing) 22 and a flat, annular glass-epoxy insulator 24.

The power source for the LED comprises two type 312 mercury 1.4 volt cells 25 and 26 which are available, for example, from the Mallory Battery Co. The two cells are arranged in series in a metal battery case 28.

At least the upper portion of the battery case 28 is lined with insulation 30, for example, of epoxy. A small, thin, polyimide PC board 32 is also provided within the case to support electronic circuit elements required for operation of the LED. The PC board carries a metal contact ring 34 which engages the negative pole of the cell 26. A layer 36 of epoxy insulation covers the surface of the PC board 32 in the region inside the ring 34. The positive pole of the cell 25 is contacted by means of an annular metal spring 38 that is supported on a spring alloy cover 40 at the back of the case 28. The cover 40 is removably held on the battery case 28 by a "snap" type closure 42 formed of an annular projection on the outer rim of the case 28 and a corresponding groove in the inner rim of the cover. The cover rim is slotted radially at intervals to facilitate flexure of the rim during engagement and disengagement.

The light source, shown in the upper portion of FIG. 1, is mechanically and electrically connected with the power source, shown in the lower portion of FIG. 1, by a stem which comprises a shaft 44, a coaxially arranged wire 46 and intermediate epoxy insulation 48. The shaft may be realized as a section of 21 gauge hypodermic tubing; that is, stainless steel tubing of the type used as a hypodermic needle. The shaft 44 is removably mounted to the metal LED base 12 by an 0.8 mm screw thread 50. This shaft 44 is fixedly mounted to the metal battery case 28 by a tight interference fit 52.

The central wire 46 within the shaft 44 extends outward beyond both ends of the shaft. At the end within the LED base 12, the wire 46 makes electrical contact with the contact spring 14. At the end within the battery case 28, the wire 46 extends through the PC board 32 and is electrically connected with the circuit on the PC board by solder 54.

As may be appreciated from viewing the structure shown in FIG. 1, the illuminating earring is worn on a pierced ear by inserting the shaft 44 through the hole in the ear from behind and then screwing the LED base 12 with the LED 10 onto the shaft until the contact spring 14 makes electrical contact with the wire 46.

The solid state lamp can be driven in virtually any manner desired, the complexity being limited only by how much circuitry will fit on the PC board 32.

Of course, the PC board may be made larger if desired although this would require a corresponding enlargement of the battery case 28.

The simplest drive circuit, shown in FIG. 2, has the lamp lit continuously using an on-board current controlling resistor 56 connected in series with the battery cells 25, 26 and the LED 10. The battery contact to the PC board is the thin metal ring 34, dimensioned to contact the periphery of the button-cell cathode. This ring is reflow soldered to a circular metallization track on the PC board. The resistor 56 is fabricated on the board in the form of a concentric, thick film ring, bridging the center electrode metallization and the battery contact metallization. In the alternative, a chip resistor may be provided between the center electrode and battery contact and reflow soldered at the same time as the contact ring. A resistor value of 150 ohms would give a current of approximately five milliamperes and a battery lifetime of approximately six hours with the LED's MV5177 or MV 5777.

FIG. 3 illustrates another embodiment wherein the constant-value resistor 56 is replaced by a temperature-dependent varistor 62 so that the brightness of the LED is modulated as a function of earlobe temperature. Other active circuit designs are also possible. For example, the brightness of the LED may be modulated as a function of static electric charge or some other variable such as the pressure between the earring and the earlobe. In the latter case, a pressure sensor must be arranged on the external surface of the case 28, on the side facing the earlobe, to provide a control signal for a variable impedance.

FIG. 4 shows still another circuit for modulating or switching the LED current by means of a transistor 64 in the battery circuit. The transistor emitter current is controlled by a suitable circuit 66 which receives power from the positive and negative battery leads 68 and 70. The control circuit may be virtually any type of circuit including the pressure sensor, mentioned above, and both the transistor and the control circuit may be arranged on a common integrated circuit.

One particularly useful control circuit is shown in FIG. 5. This circuit modulates the LED current with a free-running oscillator so as to switch the LED on and off. A low duty cycle may be chosen to yield a long battery lifetime.

In the circuit implementation shown, on-board quartz controlled oscillators 74 are used in both earrings to synchronously pulse the two lamps. Once synchronized at turn on, the earrings will remain perfectly synchronized for many hours. The quartz crystal, oscillator capacitors and resistor 76, the integrated circuit oscillator-frequency divider chip 78 and the transistor base drive circuit chip 80 are mounted on a substrate 72 and interconnected by hybrid circuit techniques. After installation in the battery case and connection to the pin center electrode, the circuit is sealed and protected by a circular metal cap, which also serves as the battery contact.

In this, and other designs employing active circuitry, the full battery voltage may be made available for powering the circuitry, by making electrical contact to the battery case. This can be done by bonding back-side circuit metallization to the battery case with conductive epoxy compound when the circuit is installed. Case contact is carried to frontside metallization with a plated-through hole in the substrate.

There has thus been shown and described a novel illuminating earring which fulfills all the objects and advantages sought therefore. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is to be limited only by the claims which follow.

I claim:

1. An illuminating earring for a pierced ear, said earring comprising, in combination:
   (a) a light source, adapted to be worn and displayed on said ear, said light source including:
      (1) a base;
      (2) an electric lamp mounted on said base; and
      (3) first circuit means disposed on said base and electrically connected to said lamp for supplying electricity to said lamp;
   (b) a power source, adapted to be worn on and hidden behind said ear, said power source including:
      (1) a case, adapted to enclose at least one battery cell; and
      (2) second circuit means, disposed in said case and electrically connected to receive current from opposite poles of said at least one battery; and
   (c) a stem mechanically and electrically inter-connecting said light source with said power source and adapted to be passed through a hole in said ear, said stem including:
      (1) a shaft having two ends, one end being fixedly mounted to one of said two sources and the other end being removably mounted to the other of said two sources; and
      (2) third circuit means extending from one end of said shaft to the other for electrically interconnecting said first and said second circuit means and providing a current conductive path and current return through said stem, whereby current flow between said light source and power source only takes place through the hole in the ear when the earring is worn and operational.

2. The earring defined in claim 1, wherein said electrical lamp is a light emitting diode.

3. The earring defined in claim 1, wherein said first circuit means includes a contact spring, mechanically and electrically connected to said lamp, said contact spring applying a contact force against a contact point on said third circuit means when said light source is mounted on said shaft.

4. The earring defined in claim 3, wherein said lamp is mechanically and electrically connected to said base, said base being electrically conductive and forming a circuit path for the flow of current between said lamp and said third circuit means.

5. The earring defined in claim 1, wherein said case comprises a housing member and a cover member, said housing member having a first side, adapted to face said ear, to which said shaft is mounted and said cover member forming a second side facing away from said first side, said cover member being removable from said housing member to permit insertion and removal of said at least one battery.

6. The earring defined in claim 1, wherein said power source further comprises two mercury battery cells arranged in series in said case.

7. The earring defined in claim 1, wherein said case is electrically conductive and forms a circuit path for the flow of current between said at least one battery and said third circuit means.

8. The earring defined in claim 1, wherein said second circuit means includes a circuit path between said at least one battery and said third circuit means.

9. The earring defined in claim 8, wherein said circuit path includes a resistor.

10. The earring defined in claim 9, wherein said resistor has a temperature-dependent characteristic.

11. The earring defined in claim 8, wherein said circuit path includes a switch for turning on and off the flow of current between said battery and said third circuit.

12. The earring defined in claim 11, wherein said switch is electronic and said second circuit means further includes electronic control means for modulating said switch.

13. The earring defined in claim 12, wherein said electronic control means includes oscillator means for repeatedly turning said switch on and off at regular intervals.

14. The earring defined in claim 1, wherein said shaft is fixedly mounted to said case and removably mounted to said base.

15. The earring defined in claim 1, wherein said shaft has a male screw thread on said other end, adapted to mate with a female screw thread on one of said base and said case.

16. The earring defined in claim 1, wherein said third circuit means includes two coaxial conductors, adapted to conduct current to and from said lamp, respectively.

17. The earring defined in claim 16, wherein said shaft is hollow and forms one of said two conductors, the other conductor extending along the central axis of said shaft and being insulated from said shaft.

18. The earring defined in claim 17, wherein said shaft is formed of hypodermic needle tubing.

* * * * *